US010373565B2

(12) United States Patent
Kwon et al.

(10) Patent No.: US 10,373,565 B2
(45) Date of Patent: Aug. 6, 2019

(54) PIXEL AND A DISPLAY DEVICE INCLUDING THE PIXEL

(71) Applicant: SAMSUNG DISPLAY CO., LTD., Yongin-si, Gyeonggi-do (KR)

(72) Inventors: Tae-Hoon Kwon, Yongin-si (KR); Seung-Kyu Lee, Asan-si (KR); Seung-Ji Cha, Seoul (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 195 days.

(21) Appl. No.: 15/438,151

(22) Filed: Feb. 21, 2017

(65) Prior Publication Data

US 2017/0309230 A1 Oct. 26, 2017

(30) Foreign Application Priority Data

Apr. 25, 2016 (KR) ..... 10-2016-0050106

(51) Int. Cl.
*G09G 3/3233* (2016.01)
*G09G 3/3266* (2016.01)
*G09G 3/3275* (2016.01)

(52) U.S. Cl.
CPC ..... *G09G 3/3275* (2013.01); *G09G 3/3233* (2013.01); *G09G 3/3266* (2013.01); *G09G 2300/0443* (2013.01); *G09G 2300/0452* (2013.01); *G09G 2300/0814* (2013.01); *G09G 2300/0819* (2013.01); *G09G 2310/0297* (2013.01); *G09G 2310/08* (2013.01)

(58) Field of Classification Search
CPC ..... G09G 3/3291; G09G 2300/0452; G09G 2310/0297; G09G 2340/06; G09G 2300/0842
See application file for complete search history.

(56) References Cited

U.S. PATENT DOCUMENTS 8,330,152 B2 * 12/2012 So ..... H01L 27/3213 257/40
2007/0040764 A1 * 2/2007 Kim ..... G09G 3/3291 345/30

(Continued)

FOREIGN PATENT DOCUMENTS

KR 10-2008-0067488 7/2008

*Primary Examiner* — Nitin Patel
*Assistant Examiner* — Amy Onyekaba
(74) *Attorney, Agent, or Firm* — F. Chau & Associates, LLC

(57) ABSTRACT

A display device includes a display panel including a plurality of scan lines, a plurality of data lines, and a plurality of unit pixels. Each unit pixel includes a plurality of sub-pixels, each coupled to a respective data line. The plurality of sub-pixels includes a red sub-pixel, a first green sub-pixel, a blue sub-pixel, and a second green sub-pixel. The display device further includes a data driver configured to output data signals via output channels. The display device additionally includes a plurality of demultiplexers configured to selectively connect data signals output from the output channels to the plurality of sub-pixels in response to a plurality of select signals that are sequentially provided to the plurality of demultiplexers. The display device further includes a scan driver configured to provide scan signals to the unit pixels through the scan lines, and a timing controller.

20 Claims, 7 Drawing Sheets

(56) References Cited

U.S. PATENT DOCUMENTS

| | | | | |
|---|---|---|---|---|
| 2013/0113997 | A1* | 5/2013 | Lee | H04N 5/70 348/624 |
| 2014/0191931 | A1* | 7/2014 | Kim | G09G 3/3291 345/76 |
| 2014/0198135 | A1* | 7/2014 | Eom | G09G 3/3275 345/690 |
| 2015/0090961 | A1* | 4/2015 | Lee | H01L 22/30 257/40 |
| 2015/0248855 | A1* | 9/2015 | Kim, II | G09G 3/2074 345/590 |
| 2015/0287378 | A1* | 10/2015 | Jeong | G09G 3/3688 345/694 |

* cited by examiner

PIXEL AND A DISPLAY DEVICE INCLUDING THE PIXEL

CROSS-REFERENCE TO RELATED APPLICATION

This application claims priority under 35 USC § 119 to Korean Patent Application No. 10-2016-0050106 filed on Apr. 25, 2016 in the Korean Intellectual Property Office (KIPO), the disclosure of which is incorporated by reference herein in its entirety.

1. TECHNICAL FIELD

One or more exemplary embodiments of the present inventive concept relate generally to a display device and an electronic device having the same. More particularly, exemplary embodiments of the present inventive concept relate to a pixel and a display device having the same.

2. DISCUSSION OF THE RELATED ART

Flat panel display (FPD) devices are widely used as a display device of electronic devices because FPD devices may be relatively lightweight and relatively thin compared to cathode-ray tube (CRT) display device. Examples of FPD devices include liquid crystal display (LCD) devices, field emission display (FED) devices, plasma display panel (PDP) devices, and organic light emitting display (OLED) devices. The OLED devices may have, for example, a relatively wide viewing angle, a relatively rapid response speed, a relatively thin thickness, relatively low power consumption, etc. However, voltage coupling when pixels are scanned may affect color deviation.

SUMMARY

One or more exemplary embodiments of the present inventive concept provide a display device that decreases a deviation of coupling between data signals provided through a demultiplexer.

One or more exemplary embodiments of the present inventive concept provide an electronic device that decreases a deviation of coupling between data signals provided through a demultiplexer.

According to an exemplary embodiment of the present inventive concept, a display device includes a display panel including a plurality of scan lines, a plurality of data lines, and a plurality of unit pixels. Each unit pixel includes a plurality of sub-pixels, each coupled to a respective data line. The plurality of sub-pixels includes a red sub-pixel, a first green sub-pixel, a blue sub-pixel, and a second green sub-pixel. The display device further includes a data driver configured to output data signals via output channels. The display device additionally includes a plurality of demultiplexers configured to selectively connect data signals output from the output channels to the plurality of sub-pixels in response to a plurality of select signals that are sequentially provided to the plurality of demultiplexers. The display device further includes a scan driver configured to provide scan signals to the unit pixels through the scan lines. The display device additionally includes a timing controller configured to control the demultiplexers, the data driver, and the scan driver.

According to an exemplary embodiment of the present inventive concept, an electronic device includes a display device and a processor that controls the display device. The display device includes a display panel including a plurality of scan lines, a plurality of data lines, and a plurality of unit pixels. Each unit pixel includes, in sequence, a red sub-pixel, a first green sub-pixel, a blue sub-pixel, and a second green sub-pixel, each sub-pixel being coupled to a respective data line. The display device further includes a data driver configured to output data signals via output channels. The display device additionally includes a plurality of demultiplexers configured to selectively connect data signals output from the output channels to the plurality of sub-pixels. A first demultiplexer is connected to a first unit pixel and a first half portion of a second unit pixel, and a second demultiplexer is connected to a second half portion of the second unit pixel and a third unit pixel. The display device further includes a scan driver configured to provide a scan signal to the unit pixels through the scan lines. The display device additionally includes a timing controller configured to control the demultiplexers, the data driver, and the scan driver.

BRIEF DESCRIPTION OF THE DRAWINGS

The above and other features of the inventive concept will become more apparent by describing in detail exemplary embodiments thereof, with reference to the accompanying, in which.

DETAILED DESCRIPTION OF THE EMBODIMENTS

Exemplary embodiments of the present inventive concept will be described in more detail below with reference to the accompanying drawings, in which exemplary embodiments of the preset inventive concept are shown.

Figure 1:
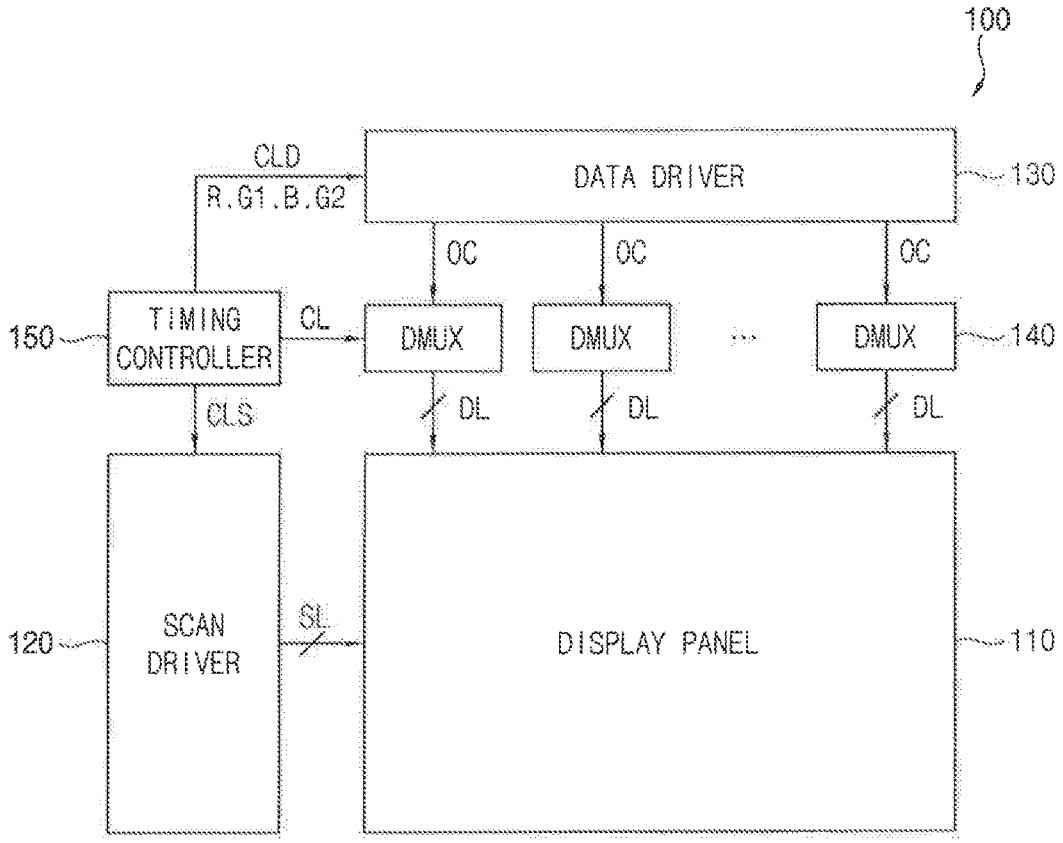
FIG. 1 is a block diagram illustrating a display device according to exemplary embodiments of the present inventive concept.
Figure 2:
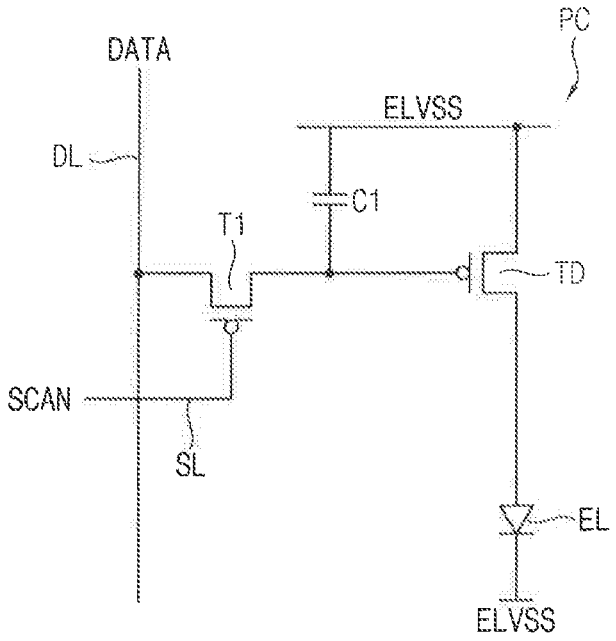
FIG. 2 is a circuit diagram illustrating an example of a pixel circuit included in the display device of FIG. 1.

FIG. 1 is a block diagram illustrating a display device according to exemplary embodiments of the present inventive concept and FIG. 2 is a circuit diagram illustrating an example of a pixel circuit included in the display device of FIG. 1.

Referring to FIG. 1, a display device 100 may include a display panel 110, a scan driver 120, a data driver 130, demultiplexers 140, and a timing controller 150. The display panel 110 may include a plurality of scan lines SL, a plurality of data lines DL, and a plurality of unit pixels.

The plurality of scan lines SL and the plurality of data lines DL may be formed on the display panel 110. The plurality of unit pixels may be formed in regions where the scan lines SL and the data lines DL intersect. Each of the unit pixels may include a red sub-pixel, a first green sub-pixel, a blue sub-pixel, and a second green sub-pixel. In an exemplary embodiment of the present inventive concept, a size of the red sub-pixel, a size of the first green sub-pixel, a size of the blue sub-pixel, and a size of the second green sub-pixel may be substantially the same. In exemplary embodiments of the present inventive concept, a size of the red sub-pixel, a size of the first green sub-pixel, a size of the blue sub-pixel, and a size of the second green sub-pixel may be different from one another. The red sub-pixel, the first green sub-pixel, the blue sub-pixel, and the second green sub-pixel may each emit light in response to an operation of a pixel circuit.

Referring to FIG. 2, the pixel circuit PC may include an organic light emitting diode EL, a switching transistor T1, a storage capacitor C1, and a driving transistor TD. The switching transistor T1 may turn on in response to a scan signal SCAN provided through the scan line SL. The data signal DATA provided through the data line DL may be stored in the storage capacitor C1. The data signal DATA may be provided through the data line DL during a data input period of the unit pixels. The driving transistor TD may generate a driving current that may be provided to the organic light emitting diode EL in response to the data signal DATA. The organic light emitting diode EL may emit light based on the driving current.

The scan driver 120 may generate a scan signal SCAN in response to a scan control signal CLS provided from the timing controller 150. The scan driver 120 may provide the scan signal SCAN to the unit pixels.

The data driver 130 may generate a data signal DATA based on an input signal R, G1, B, G2 and a data control signal CLD provided from the timing controller 150. The data driver 130 may convert the input signal R, G1, B, G2, which is a digital signal, to an analog signal (a voltage) corresponding to the received digital signal. The data driver 130 may provide the data signal DATA to the demultiplexers 140 through output channels OC using, for example, a timing divisional technique. For example, the data driver 130 may output the data signal DATA to sub-pixels that are arranged in six rows through one output channel OC, a demultiplexer 140, and a data line DL by using the timing divisional technique.

In response to a plurality of select signals CL sequentially provided from the timing controller 150, the demultiplexer 140 may control an amount of coupling between data lines DL by controlling the data signal DATA, which may be provided to the unit pixels. When the demultiplexer 140 provides the data signal DATA to the unit pixels through the data lines DL, a coupling effect may occur on adjacent data lines DL. The demultiplexer 140 of FIG. 1 may allow a particular amount of coupling, which affects data lines DL coupled to the sub-pixels having the same color, to be substantially the same for sub-pixels having the same color by controlling an input sequence of the data signal DATA provided through the data lines DL. Thus, the voltage levels of the data signal DATA provided to the sub-pixels having the same color may be the same. For example, the demultiplexer 140 may allow a particular amount of coupling to be substantially the same for the data lines DL coupled to the red sub-pixels, a particular amount of coupling to be substantially the same for the data lines DL coupled to the first green sub-pixels to be the same, a particular amount of coupling to be substantially the same for the data lines DL coupled to the blue sub-pixels, and a particular amount of coupling to be substantially the same for the data lines DL coupled to the second green sub-pixels. The demultiplexer 140 may control the data signal DATA provided through the data lines DL based on select switching transistors (e.g., TS1, TS2, TS3, TS4, TS5, TS6) turned on or off in response to the select signals CL sequentially provided from the timing controller 150. The demultiplexer 140 will be described in detail referring to FIGS. 4 through 7.

The timing controller 150 may control the scan driver 120, the data driver 130, and the demultiplexers 140. The timing controller 150 may provide the scan control signal CLS to the scan driver 120. The timing controller 150 may provide the input signal R, G1, B, G2 and the data control signal CLD to the data driver 130. Further, the timing controller 150 may provide the select signals CL, which control the operation of the demultiplexers 140, to the demultiplexers 140.

As described above, the display device 100 of FIG. 1 may control the data signal DATA provided to the unit pixels in the display panel 110 by including the demultiplexers 140 positioned between the data driver 130 and the display panel 110. The demultiplexers 140 may allow a particular amount of the coupling, which affects the data lines DL coupled to the sub-pixels having the same color, to be substantially the same for sub-pixels having the same color. Thus, the voltage level of the data signals DATA provided to the sub-pixels having the same color and that are coupled to the effected data lines DL may be substantially the same. Therefore, a color deviation of the sub-pixels that are coupled to the effected data lines DL may be improved.

Figure 3:
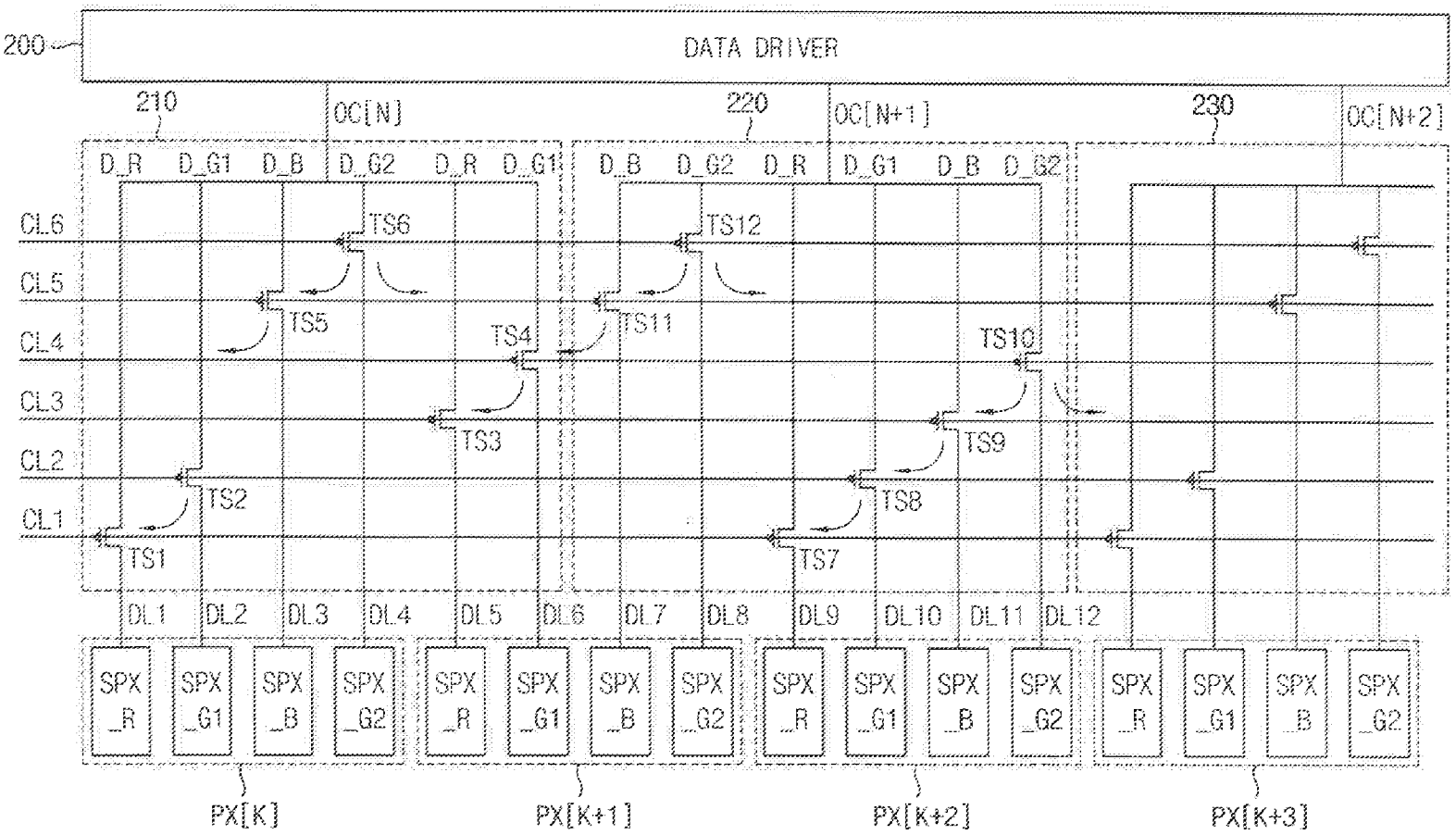
FIG. 3 is a diagram illustrating an example of a demultiplexer included in the display device of FIG. 1.
Figure 4:
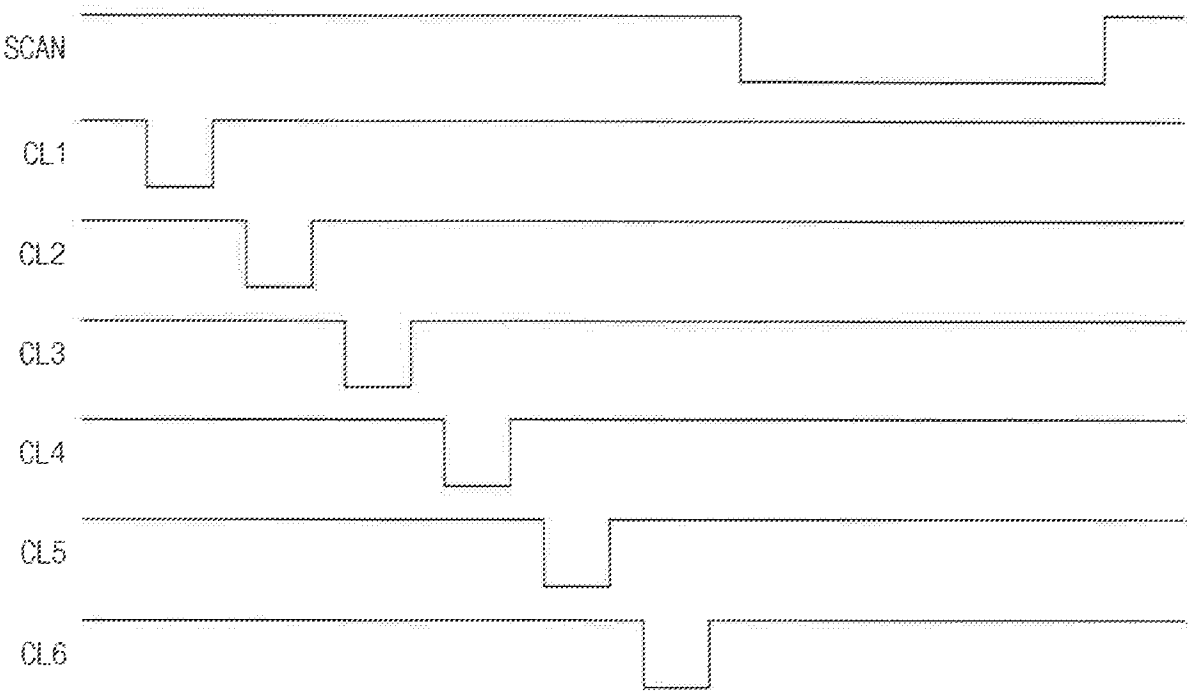
FIG. 4 illustrates a timing diagram for describing an operation of the demultiplexer of FIG. 3.

FIG. 3 is a diagram illustrating an example of a demultiplexer 140 included in the display device 100 of FIG. 1 and FIG. 4 illustrates a timing diagram for describing an operation of the demultiplexer 140 of FIG. 3.

Referring to FIG. 3, the display device 100 may include an Nth demultiplexer 210 coupled to an Nth output channel OC[N] of a data driver 200, an (N+1)th demultiplexer 220 coupled to an (N+1)th output channel OC[N+1] of the data driver 200, and an (N+2)th demultiplexer 230 coupled to an (N+2)th output channel OC[N+2] of the data driver 200.N is an integer equal to or greater than 1.

The Nth demultiplexer 210 may be coupled to a red sub-pixel SPX_R of a Kth unit pixel PX[K] through a first data line DL1, to a first green sub-pixel SPX_G1 of the Kth unit pixel PX[K] through a second data line DL2, to a blue sub-pixel SPX_B of the Kth unit pixel PX[K] through the third data line DL3, to a second green sub-pixel SPX_G2 of the Kth unit pixel PX[K] through the fourth data line DL4, to a red sub-pixel SPX_R of a (K+1)th unit pixel PX[K+1] through the fifth data line DL5, and/or to a first green sub-pixel SPX_G1 of a (K+1)th unit pixel PX[K+1] through the sixth data line DL6.K is an integer equal to or greater than 1. The Nth demultiplexer 210 may include a first select switching transistor TS1, a second select switching transistor TS2, a third select switching transistor TS3, a fourth select switching transistor TS4, a fifth select switching transistor TS5, and a sixth select switching transistor TS6.

The first select switching transistor TS1 of the Nth demultiplexer 210 may couple the Nth output channel OC[N] to the first data line DL1, which may be coupled to the red sub-pixel SPX_R of the Kth unit pixel PX[K], in response to a first select signal CL1. When the first select switching transistor TS1 turns on, a red data signal D_R provided from (e.g., generated by) the data driver 200 and through the Nth output channel OC[N] may be provided to the red sub-pixel SPX_R of the Kth unit pixel PX[K] through the first data line DL coupled to the Nth demultiplexer 210. The second select switching transistor TS2 of the Nth demultiplexer 210 may couple the Nth output channel OC[N] to the second data line DL2, which may be coupled to the first green sub-pixel SPX_G1 of the Kth unit pixel PX[K], in response to a second select signal CL2. When the second select switching transistor TS2 turns on, a first green data signal D_G1 provided from the data driver 200 and through the Nth output channel OC[N] may be provided to the first green sub-pixel SPX_G1 of the Kth unit pixel PX[K] through the second data line DL2 coupled to the Nth demultiplexer 210. The third select switching transistor TS3 of the Nth demultiplexer 210 may couple the Nth output channel OC[N] to the fifth data line DL5, which may be coupled to the red sub-pixel SPX_R of the (K+1)th unit pixel PX[K+1], in response to a third select signal CL3. When the third select switching transistor TS3 turns on, a red data signal D_R provided from the data driver 200 and through the Nth output channel OC[N] may be provided to the red sub-pixel SPX_R of the (K+1)th unit pixel PX[K+1] through the fifth data line DL5 coupled to the Nth demultiplexer 210. The fourth select switching transistor TS4 of the Nth demultiplexer 210 may couple the Nth output channel OC[N] to the sixth data line DL6, which may be coupled to the first green sub-pixel SPX_G1 of the (K+1)th unit pixel PX[K+1], in response to a fourth select signal CL4. When the fourth select switching transistor TS4 turns on, a first green data signal D_G1 provided from the data driver 200 and through the Nth output channel OC[N] may be provided to the first green sub-pixel SPX_G1 of the (K+1)th unit pixel PX[K+1] through the sixth data line DL6 coupled to the Nth demultiplexer 210. The fifth select switching transistor TS5 of the Nth demultiplexer 210 may couple the Nth output channel OC[N] to the third data line DL3, which may be coupled to the blue sub-pixel SPX_B of the Kth unit pixel PX[K], in response to a fifth select signal CL5. When the fifth select switching transistor TS5 turns on, a blue data signal D_B provided from the data driver 200 and through the Nth output channel OC[N] may be provided to the blue sub-pixel SPX_B of the Kth unit pixel PX[K] through the third data line DL3 coupled to the Nth demultiplexer 210. The sixth select switching transistor TS6 of the Nth demultiplexer 210 may couple the Nth output channel OC[N] to the fourth data line DL4, which may be coupled to the second green sub-pixel SPX_G2 of the Kth unit pixel PX[K], in response to a sixth select signal CL6. When the sixth select switching transistor TS6 turns on, a second green data signal D_G2 provided from the data driver 200 and through the Nth output channel OC[N] may be provided to the second green sub-pixel SPX_G2 of the Kth unit pixel PX[K] through the fourth data line DL4 coupled to the Nth demultiplexer 210.

The timing controller 150 may sequentially provide the first through sixth select signals CL1 through CL6 to the Nth demultiplexer 210 as described in FIG. 4. Referring to FIG. 3, when the first select signal CL1 is provided from the timing controller 150 and received by the first select switching transistor TS1, the first select switching transistor TS1 may turn on. The red data signal D_R provided from the data driver 200 and through the Nth output channel OC[N] may be provided to the first data line DL1. When the second select signal CL2 is provided from the timing controller 150 and received by the second select switching transistor TS2, the second select switching transistor TS2 may turn on. The first green data signal D_G provided from the data driver 200 and through the Nth output channel OC[N] may be provided to the second data line DL2 through the Nth output channel OC[N]. When the first green data signal D_G1 is provided to the second data line DL2, a voltage level of the red data signal D_R provided to the first data line DL1 adjacent to the second data line DL2 may be changed. When the third select signal CL3 is provided from the timing controller 150 and received by the third select switching transistor TS3, the third select switching transistor TS3 may turn on. The red data signal D_R provided from the data driver 200 and through the Nth output channel OC[N] may be provided to the fifth data line DL5. When the fourth select signal CL4 is provided from the timing controller 150 and received by the fourth select switching transistor TS4, the fourth select switching transistor TS4 may turn on. The first green data signal D_G1 provided from the data driver 200 and through the Nth output channel OC[N] may be provided to the sixth data line DL6. When the first green data signal D_G1 is provided to the sixth data line DL6, a voltage level of the red data signal D_R provided to the fifth data line DL5 adjacent to the sixth data line DL6 may be changed. When the fifth select signal CL5 is provided from the timing controller 150 and received by the fifth select switching transistor TS5, the fifth select switching transistor TS5 may turn on. The blue data signal D_B provided from the data driver 200 and through the Nth output channel OC[N] may be provided to the third data line DL3. When the blue data signal is provided to the third data line DL3, a voltage level of the first green data signal D_G1 provided to the second data line DL2 adjacent to the third data line DL3 may be changed. When the sixth select signal CL6 is provided from the timing controller 150 and received by the sixth select switching transistor TS6, the sixth select switching transistor TS6 may turn on. The second green data signal D_G2 provided from the data driver 200 and through the Nth output channel OC[N] may be provided to the fourth data line DL4. When the second green data signal D_G2 is provided to the fourth data line DL4, a voltage level of the blue data signal D_B provided to the third data line DL3 adjacent to the fourth data line DL4 and a voltage level of the red data signal D_R provided to the fifth data line DL5 adjacent to the fourth data line DL4 may be changed.

The (N+1)th demultiplexer 220 may be coupled to a blue sub-pixel SPX_B of the (K+1)th unit pixel PX[K+1] through a seventh data line DL7, to a second green sub-pixel SPX_G2 of the (K+1)th unit pixel PX[K+1] through an eighth data line DL8, to a red sub-pixel SPX_R of the (K+2)th unit pixel PX[K+2] through a ninth data line DL9, to a first green pixel SPX_G1 of the (K+2)th unit pixel PX[K+2] through a tenth data line DL10, to a blue sub-pixel SPX_B of the (K+2)th unit pixel PX[K+2] through an eleventh data line DL11, and/or to a second green sub-pixel SPX_G2 the (K+2)th unit pixel PX[K+2] through a twelfth data line DL12. K is an integer equal to or greater than 1. The (N+1)th demultiplexer 220 may include a seventh select switching transistor TS7, an eighth select switching transistor TS8, a ninth select switching transistor TS9, a tenth select switching transistor TS10, an eleventh select switching transistor TS11, and a twelfth select switching transistor TS12.

The seventh select switching transistor TS7 of the (N+1)th demultiplexer 220 may couple the (N+1)th output channel OC[N+1] to the ninth data line DL9, which may be coupled to the red sub-pixel SPX_R of the (K+2)th unit pixel PX[K+2], in response to the first select signal CL1. When the seventh select switching transistor TS7 turns on, a red data signal D_R provided from the data driver 200 and through the (N+1)th output channel OC[N+1] may be provided to the red sub-pixel of SPX_R of the (K+2)th unit pixel PX[K+2] through the ninth data line DL9 coupled to the (N+1)th demultiplexer 220. The eighth select switching transistor TS8 may couple the (N+1)th output channel OC[N+1] to the tenth data line DL10, which may be coupled to the first green sub-pixel SPX_G1 of the (K+2)th unit pixel PX[K+2], in response to the second select signal CL2. When the eighth select switching transistor TS8 turns on, a first green data signal D_G1 provided from the data driver 200 and through the (N+1)th output channel OC[N+1] may be provided to the first green sub-pixel of SPX_G1 of the (K+2)th unit pixel PX[K+2] through the tenth data line DL10 coupled to the (N+1)th demultiplexer 220. The ninth select switching transistor TS9 may couple the (N+1)th output channel OC[N+1] to the eleventh data line DL11, which may be coupled to the blue sub-pixel SPX_B of the (K+2)th unit pixel PX[K+2], in response to the third select signal CL3. When the ninth select switching transistor TS9 turns on, a blue data signal D_B provided from the data driver 200 and through the (N+1)th output channel OC[N+1] may be provided to the blue sub-pixel of SPX_B of the (K+2)th unit pixel PX[K+2] through the eleventh data line DL11 coupled to the (N+1)th demultiplexer 220. The tenth select switching transistor TS10 may couple the (N+1)th output channel OC[N+1] to the twelfth data line DL12, which may be coupled to the second green sub-pixel SPX_G2 of the (K+2)th unit pixel PX[K+2], in response to the fourth select signal CL4. When the tenth select switching transistor TS10 turns on, a second green data signal D_G2 provided from the data driver 200 and through the (N+1)th output channel OC[N+1] may be provided to the second green sub-pixel of SPX_G2 of the (K+2)th unit pixel PX[K+2] through the twelfth data line DL12 coupled to the (N+1)th demultiplexer 220. The eleventh select switching transistor TS11 may couple the (N+1)th output channel OC[N+1] to the seventh data line DL7, which may be coupled to the blue sub-pixel SPX_B of the (K+1)th unit pixel PX[K+1], in response to the fifth select signal CL5. When the eleventh select switching transistor TS1*l* turns on, a blue data signal D_B provided from the data driver 200 and through the (N+1)th output channel OC[N+1] may be provided to the blue sub-pixel of SPX_B of the (K+1)th unit pixel PX[K+1] through the seventh data line DL7 coupled to the (N+1)th demultiplexer 220. The twelfth select switching transistor TS12 may couple the (N+1)th output channel OC[N+1] to the eighth data line DL8, which may be coupled to the second green sub-pixel SPX_G2 of the (K+1)th unit pixel PX[K+1], in response to the sixth select signal CL6. When the twelfth select switching transistor TS12 turns on, a second green data signal D_G2 provided from the data driver 200 and through the (N+1)th output channel OC[N+1] may be provided to the second green sub-pixel of SPX_G2 of the (K+1)th unit pixel PX[K+1] through the eighth data line DL8 coupled to the (N+1)th demultiplexer 220.

The timing controller 150 may sequentially provide the first through sixth select signals CL1 through CL6 to the (N+1)th demultiplexer 220 as described in FIG. 4. Referring to FIG. 3, when the first select signal CL1 is provided from the timing controller 150 and received by the seventh select switching transistor TS7, the seventh select switching transistor TS7 may turn on. The red data signal D_R provided from the data driver 200 may be provided to the ninth data line DL9 through the (N+1)th output channel OC[N+1]. When the second select signal CL2 is provided from the timing controller 150 and received by the eighth select switching transistor TS8, the eighth select switching transistor TS8 may turn on. The first green data signal D_G1 provided from the data driver 200 may be provided to the tenth data line DL10 through the (N+1)th output channel OC[N+1]. When the first green data signal D_G1 is provided to the tenth data line DL10, a voltage level of the red data signal D_R provided to the ninth data line DL9 adjacent to the tenth data line DL10 may be changed. When the third select signal CL3 is provided from the timing controller 150 and received by the ninth select switching transistor TS9, the ninth select switching transistor TS9 may turn on. The blue data signal D_B provided from the data driver 200 may be provided to the eleventh data line DL11 through the (N+1)th output channel OC[N+1]. When the blue data signal D_B is provided to the eleventh data line DL11, a voltage level of the first data signal D_G1 provided to the tenth data line DL10 adjacent to the eleventh data line DL11 may be changed. When the fourth select signal CL4 is provided from the timing controller 150 and received by the tenth select switching transistor TS10, the tenth select switching transistor TS10 may turn on. The second green data signal D_G2 provided from the data driver 200 may be provided to the twelfth data line DL12 through the (N+1)th output channel OC[N+1]. When the second green data signal D_G2 is provided to the twelfth data line DL12, a voltage level of the blue data signal D_B provided to the eleventh data line DL11 adjacent to the twelfth data line DL12 may be changed. When the fifth select signal CL5 is provided from the timing controller 150 and received by the eleventh select switching transistor TS11, the eleventh select switching transistor TS11 may turn on. The blue data signal D_B provided from the data driver 200 may be provided to the seventh data line DL7 through the (N+1)th output channel OC[N+1]. When the blue data signal D_B is provided to the seventh data line DL7, a voltage level of the first green data signal D_G1 provided to the sixth data line DL6 adjacent to the seventh data line DL7 and of the Nth demultiplexer 210 may be changed. When the sixth select signal CL6 is provided from the timing controller 150 and received by the twelfth select switching transistor TS12, the twelfth select switching transistor TS12 may turn on. The second green data signal D_G2 provided from the data driver 200 may be provided to the eighth data line DL8 through the (N+1)th output channel OC[N+1]. When the first green data signal D_G1 is provided to the eighth data line DL8, a voltage level of the blue data signal D_B provided to the seventh data line DL7 adjacent to the eighth data line DL8 and a voltage level of the red data signal D_R provided to the ninth data line DL9 adjacent to the eighth data line DL8 may be changed.

The demultiplexers 210, 220 and 230 of FIG. 3 may allow a particular amount of coupling to be substantially the same for the data lines DL coupled to the sub-pixels having the same color. In other words, in the demultiplexers 210, 220 and 230, each data line corresponding to a sub-pixel having the same color in each unit pixel PX[K], PX[K+1], PX[K+2] and PX[K+3] may be affected by a particular coupling performed on an adjacent data line by a select switching transistor corresponding to another sub-pixel having the same color in each unit pixel PX[K], PX[K+1], PX[K+2] and PX[K+3]. For example, the voltage level of the first green data signal D_G1 provided to the second data line DL2 coupled to the first green sub-pixel SPX_G1 of the Kth unit pixel PX[K] may be changed by the blue data signal D_B provided to the third data line DL3 adjacent to the second data line DL2. The voltage level of the first green data signal D_G1 provided to the sixth data line DL6 coupled to the first green sub-pixel of the (K+1)th unit pixel PX[K+1] may be changed by the blue data signal D_B provided to the seventh data line DL7 adjacent to the sixth data line DL6. The voltage level of the first green data signal D_G1 provided to the tenth data line DL10 coupled to the first green sub-pixel of the (K+2)th unit pixel PX[K+2] may be changed by the blue data signal D_B provided to the eleventh data line DL11 adjacent to the tenth data line DL10. For example, for each unit pixel PX[K], PX[K+1], PX[K+2] and PX[K+3], the voltage level of the first green data signal D_G1 provided to the first green sub-pixel SPX_G1 included in each of the unit pixels PX[K], PX[K+1], PX[K+2] and PX[K+3] may be changed by the coupling effect generated by the blue data signal D_B provided to the blue sub-pixel SPX_B adjacent to the first green sub-pixel SPX_G1. Thus, the voltage level of the first green data signal D_G1 provided to the first green sub-pixel SPX_G1 included in each of the unit pixels PX[K], PX[K+1], PX[K+2] and PX[K+3] may be the same. Therefore, a color variation of the first green sub-pixels SPX_G1 included in the unit pixels PX[K], PX[K+1], PX[K+2] and PX[K+3] may be improved.

Figure 5:
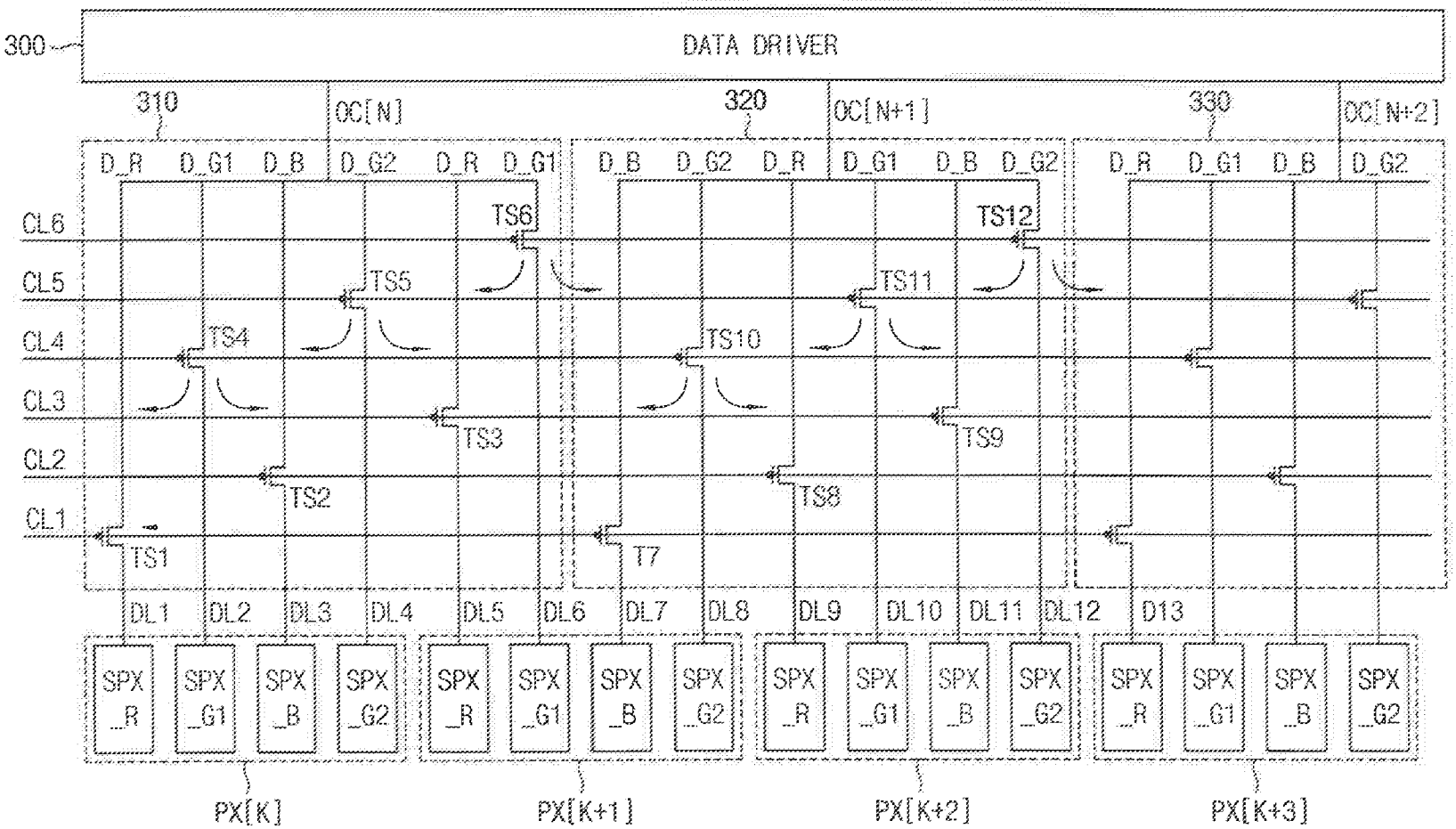
FIG. 5 is a diagram illustrating an example of a demultiplexer included in the display device FIG. 1.
Figure 6:
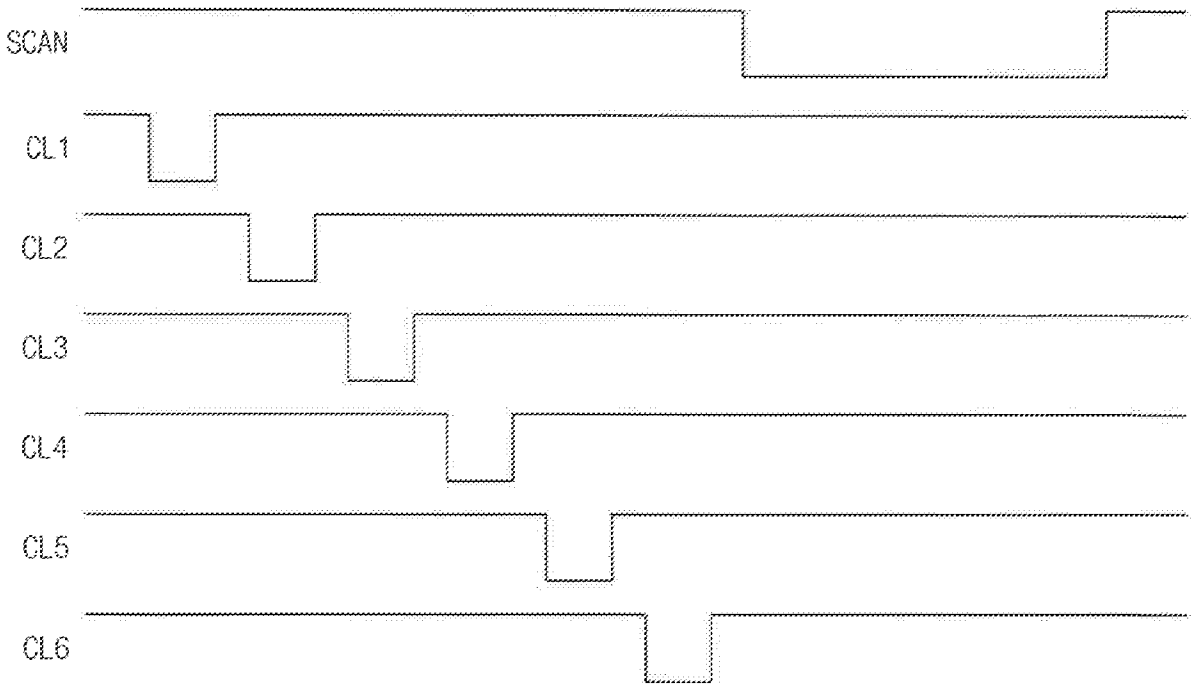
FIG. 6 illustrates a timing diagram for describing an operation of the demultiplexer of FIG. 5.

FIG. 5 is a diagram illustrating an example of a demultiplexer included in the display device FIG. 1 and FIG. 6 illustrates a timing diagram for describing an operation of the demultiplexer of FIG. 5.

Referring to FIG. 5, a display device 100 may include an Nth demultiplexer 310 coupled to an Nth output channel OC[N] of a data driver 300, an (N+1)th demultiplexer 320 coupled to an (N+1)th output channel OC[N+1] of the data driver 300 and an (N+2)th demultiplexer 330 coupled to an (N+2)th output channel OC[N+2] of the data driver 300. N is an integer equal to or greater than 1.

The Nth demultiplexer 310 may be coupled to a red sub-pixel SPX_R of a Kth unit pixel PX[K] through a first data line DL1, to a first green sub-pixel SPX_G1 of the Kth unit pixel PX[K] through a second data line DL2, to a blue sub-pixel SPX_B of the Kth unit pixel PX[K] through the third data line DL3, to a second green sub-pixel SPX_G2 of the Kth unit pixel PX[K] through the fourth data line DL4, to a red sub-pixel SPX_R of a (K+1)th unit pixel PX[K+1] through the fifth data line DL5, and/or to a first green sub-pixel SPX_G1 of a (K+1)th unit pixel PX[K+1] through the sixth data line DL6. The K is an integer equal to or greater than 1. The Nth demultiplexer 310 may include a first select switching transistor TS1, a second select switching transistor TS2, a third select switching transistor TS3, a fourth select switching transistor TS4, a fifth select switching transistor TS5, and a sixth select switching transistor TS6.

The first select switching transistor TS1 of the Nth demultiplexer 310 may couple the Nth output channel OC[N] to the first data line DL1, which may be coupled to the red sub-pixel SPX_R of the Kth unit pixel PX[K], in response to a first select signal CL1. When the first select switching transistor TS1 turns on, a red data signal D_R provided from (e.g., generated by) the data driver 300 and through the Nth output channel OC[N] may be provided to the red sub-pixel SPX_R of the Kth unit pixel PX[K] through the first data line DL1 coupled to the Nth demultiplexer 310. The second select switching transistor TS2 of the Nth demultiplexer 310 may couple the Nth output channel OC[N] to the third data line DL3, which may be coupled to the blue sub-pixel SPX_B of the Kth unit pixel PX[K], in response to a second select signal CL2. When the second select switching transistor TS2 turns on, a blue data signal D_B provided from the data driver 300 and through the Nth output channel OC[N] may be provided to the blue sub-pixel SPX_B of the Kth unit pixel PX[K] through the third data line DL3 coupled to the Nth demultiplexer 310. The third select switching transistor TS3 of the Nth demultiplexer 310 may couple the Nth output channel OC[N] to the fifth data line DL5, which may be coupled to the red sub-pixel SPX_R of the (K+1)th unit pixel PX[K+1], in response to a third select signal CL3. When the third select switching transistor TS3 turns on, a red data signal D_R provided from the data driver 300 and through the Nth output channel OC[N] may be provided to the red sub-pixel SPX_R of the (K+1)th unit pixel PX[K+1] through the fifth data line DL5 coupled to the Nth demultiplexer 310. The fourth select switching transistor TS4 of the Nth demultiplexer 310 may couple the Nth output channel OC[N] to the second data line DL2, which may be coupled to the first green sub-pixel SPX_G1 of the Kth unit pixel PX[K], in response to a fourth select signal CL4. When the fourth select switching transistor TS4 turns on, a first green data signal D_G1 provided from the data driver 300 and through the Nth output channel OC[N] may be provided to the first green sub-pixel SPX_G1 of the Kth unit pixel PX[K] through the second data line DL2 coupled to the Nth demultiplexer 310. The fifth select switching transistor TS5 of the Nth demultiplexer 310 may couple the Nth output channel OC[N] to the fourth data line DL4, which may be coupled to the second green sub-pixel SPX_G2 of the Kth unit pixel PX[K], in response to a fifth select signal CL5. When the fifth select switching transistor TS5 turns on, a second green data signal D_G2 provided from the data driver 300 and through the Nth output channel OC[N] may be provided to the second green sub-pixel SPX_G2 of the Kth unit pixel PX[K] through the fourth data line DL4 coupled to the Nth demultiplexer 310. The sixth select switching transistor TS6 of the Nth demultiplexer 310 may couple the Nth output channel OC[N] to the sixth data line DL6, which may be coupled to the first green sub-pixel SPX_G1 of the (K+1)th unit pixel PX[K+1], in response to a sixth select signal CL6. When the sixth select switching transistor TS6 turns on, a first green data signal D_G1 provided from the data driver 300 and through the Nth output channel OC[N] may be provided to the first green sub-pixel SPX_G1 of the (K+1)th unit pixel PX[K+1] through the sixth data line DL6 coupled to the Nth demultiplexer 310.

The timing controller 150 may sequentially provide the first through sixth select signals CL1 through CL6 to the Nth demultiplexer 310 as described in FIG. 6. Referring to FIG. 5, when the first select signal CL1 is provided from the timing controller 150 and received by the first select switching transistor TS11, the first select switching transistor TS1 may turn on. The red data signal D_R provided from the data driver 300 and through the Nth output channel OC[N] may be provided to the first data line DL1. When the second select signal CL2 is provided from the timing controller 150 and received by the second select switching transistor TS2, the second select switching transistor TS2 may turn on. The blue data signal D_B provided from the data driver 300 and through the Nth output channel OC[N] may be provided to the third data line DL3. When the third select signal CL3 is provided from the timing controller 150 and received by the third select switching transistor TS3, the third select switching transistor TS3 may turn on. The red data signal D_R provided from the data driver 300 and through the Nth output channel OC[N] may be provided to the fifth data line DL5. When the fourth select signal CL4 is provided from the timing controller 150 and received by the fourth select switching transistor TS4, the fourth select switching transistor TS4 may turn on. The first green data signal D_G1 provided from the data driver 300 and through the Nth output channel OC[N] may be provided to the second data line DL2. When the first green data signal D_G1 is provided to the second data line DL2, a voltage level of the red data signal D_R provided to the first data line DL1 adjacent to the second data line DL2 and a voltage level of the blue data signal D_B provided to the third data line DL3 adjacent to the second data line DL2 may be changed. When the fifth select signal CL5 is provided from the timing controller 150 and received by the fifth select switching transistor TS5, the fifth select switching transistor TS5 may turn on. The second green data signal D_G2 provided from the data driver 300 and through the Nth output channel OC[N] may be provided to the fourth data line DL4. When the second green data signal D_G2 is provided to the fourth data line DL4, a voltage level of the blue data signal D_B provided to the third data line DL3 adjacent to the fourth data line DL4 and a voltage level of the red data signal D_R provided to the fifth data line DL5 adjacent to the fourth data line DL4 may be changed. When the sixth select signal CL6 is provided from the timing controller 150 and received by the sixth select switching transistor TS6, the sixth select transistor TS6 may turn on. The first green data signal D_G2 provided from the data driver 300 and through the Nth output channel OC[N] may be provided to the sixth data line DL6. When the first green data signal D_G1 is provided to the sixth data line DL6, a voltage level of the red data signal D_R provided to the fifth data line DL5 adjacent to the sixth data line DL6 and a voltage level of the blue data signal D_B provided to a seventh data line DL7 adjacent to the sixth data line DL6 may be changed.

The (N+1)th demultiplexer 320 may be coupled to a blue sub-pixel SPX_B of the (K+1)th unit pixel PX[K+1] through the seventh data line DL7, to a second green sub-pixel SPX_G2 of the (K+1)th unit pixel PX[K+1] through an eighth data line DL8, to a red sub-pixel SPX_R of the (K+2)th unit pixel PX[K+2] through a ninth data line DL9, to a first green pixel SPX_G1 of the (K+2)th unit pixel PX[K+2] through a tenth data line DL10, to a blue sub-pixel SPX_B of the (K+2)th unit pixel PX[K+2] through an eleventh data line DL11, and/or to a second green sub-pixel SPX_G2 the (K+2)th unit pixel PX[K+2] through a twelfth data line DL12. K is an integer equal to or greater than 1. The (N+1)th demultiplexer 320 may include a seventh select switching transistor TS7, an eighth select switching transistor TS8, a ninth select switching transistor TS9, a tenth select switching transistor TS10, an eleventh select switching transistor TS11, and a twelfth select switching transistor TS12.

The seventh select switching transistor TS7 of the (N+1)th demultiplexer 320 may couple the (N+1)th output channel OC[N+1] to the seventh data line DL7, which may be coupled to the blue sub-pixel SPX_B of the (K+1)th unit pixel PX[K+1], in response to the first select signal CL1. When the seventh select switching transistor TS7 turns on, a blue data signal D_B provided from the data driver 300 and through the (N+1)th output channel OC[N+1] may be provided to the blue sub-pixel of SPX_B of the (K+1)th unit pixel PX[K+1] through the seventh data line DL7 coupled to the (N+1)th demultiplexer 320. The eighth select switching transistor TS8 may couple the (N+1)th output channel OC[N+1] to the ninth data line DL9, which may be coupled to the red sub-pixel SPX_R of the (K+2)th unit pixel PX[K+2], in response to the second select signal CL2. When the eighth select switching transistor TS8 turns on, a red data signal D_R provided from the data driver 300 and through the (N+1)th output channel OC[N+1] may be provided to the red sub-pixel of SPX_R of the (K+2)th unit pixel PX[K+2] through the ninth data line DL9 coupled to the (N+1)th demultiplexer 320. The ninth select switching transistor TS9 may couple the (N+1)th output channel OC[N+1] to the eleventh data line DL11, which may be coupled to the blue sub-pixel SPX_B of the (K+2)th unit pixel PX[K+2], in response to the third select signal CL3. When the ninth select switching transistor TS9 turns on, a blue data signal D_B provided from the data driver 300 and through the (N+1)th output channel OC[N+1] may be provided to the blue sub-pixel of SPX_B of the (K+2)th unit pixel PX[K+2] through the eleventh data line DL11 coupled to the (N+1)th demultiplexer 320. The tenth select switching transistor TS10 may couple the (N+1)th output channel OC[N+1] to the eighth data line DL8, which may be coupled to the second green sub-pixel SPX_G2 of the (K+1)th unit pixel PX[K+1], in response to the fourth select signal CIA. When the tenth select switching transistor TS10 turns on, a second green data signal D_G2 provided from the data driver 300 and through the (N+1)th output channel OC[N+1] may be provided to the second green sub-pixel of SPX_G2 of the (K+1)th unit pixel PX[K+1] through the eighth data line DL8 coupled to the (N+1)th demultiplexer 320. The eleventh select switching transistor TS11 may couple the (N+1)th output channel OC[N+1] to the tenth data line DL10, which may be coupled to the first green sub-pixel SPX_G1 of the (K+2)th unit pixel PX[K+2], in response to the fifth select signal CL5. When the eleventh select switching transistor TS11 turns on, a first green data signal D_G1 provided from the data driver 300 and through the (N+1)th output channel OC[N+1] may be provided to the first green sub-pixel of SPX_G of the (K+2)th unit pixel PX[K+2] through the tenth data line DL10 coupled to the (N+1)th demultiplexer 320. The twelfth select switching transistor TS12 may couple the (N+1)th output channel OC[N+1] to the twelfth data line DL12, which may be coupled to the second green sub-pixel SPX_G2 of the (K+2)th unit pixel PX[K+2], in response to the sixth select signal CL6. When the twelfth select switching transistor TS12 turns on, a second green data signal D_G2 provided from the data driver 300 and through the (N+1)th output channel OC[N+1] may be provided to the second green sub-pixel of SPX_G2 of the (K+2)th unit pixel PX[K+2] through the twelfth data line DL12 coupled to the (N+1)th demultiplexer 320.

The timing controller 150 may sequentially provide the first through sixth select signals CL1 through CL6 to the (N+1)th demultiplexer 320 as described in FIG. 6. Referring to FIG. 5, when the first select signal CL1 is provided from the timing controller 150 and received by the seventh select switching transistor TS7, the seventh select switching transistor TS7 may turn on. The blue data signal D_B provided from the data driver 300 may be provided to the seventh data line DL7 through the (N+1)th output channel OC[N+1]. When the second select signal CL2 is provided from the timing controller 150 and received by the eighth select switching transistor TS8, the eighth select switching transistor TS8 may turn on. The red data signal D_R provided from the data driver 300 may be provided to the ninth data line DL9 through the (N+1)th output channel OC[N+1]. When the third select signal CL3 is provided from the timing controller 150 and received by the ninth select switching transistor TS9, the ninth select switching transistor TS9 may turn on. The blue data signal D_B provided from the data driver 300 may be provided to the eleventh data line DL11 through the (N+1)th output channel OC[N+1]. When the fourth select signal CIA is provided from the timing controller 150 and received by the tenth select switching transistor TS10, the tenth select switching transistor TS10 may turn on. The second green data signal D_G2 provided from the data driver 300 may be provided to the eighth data line DL8 through the (N+1)th output channel OC[N+1]. When the second green data signal D_G2 is provided to the eighth data line DL8, a voltage level of the blue data signal D_B provided to the seventh data line DL7 adjacent to the eighth data line DL8 and a voltage level of the red data signal D_R provided to the ninth data line DL9 adjacent to the eighth data line DL8 may be changed. When the fifth select signal CL5 is provided from the timing controller 150 and received by the eleventh select switching transistor TS11, the eleventh switching transistor TS11 may turn on. The first green data signal D_G1 provided from the data driver 300 may be provided to the tenth data line DL10 through the (N+1)th output channel OC[N+1]. When the first green data signal D_G1 is provided to the tenth data line DL7, a voltage level of the red data signal D_R provided to the ninth data line DL9 adjacent to the tenth data line DL10 and a voltage level of the blue data signal D_B provided to the eleventh data line DL11 adjacent to the tenth data line DL10 may be changed. When the sixth select signal CL6 is provided from the timing controller 150 and received by the twelfth select switching transistor TS12, the twelfth select switching transistor TS12 may turn on. The second green data signal D_G2 provided from the data driver 300 may be provided to the twelfth data line DL12 through the (N+1)th output channel OC[N+1]. When the second green data signal D_G2 is provided to the twelfth data line DL12, a voltage level of the blue data signal D_B provided to the eleventh data line DL11 adjacent to the twelfth data line DL12 and a voltage level of the red data signal D_R provided to a thirteenth data line DL13 adjacent to the twelfth data line DL12 may be changed.

The demultiplexers 310, 320 and 330 of FIG. 5 may allow a particular amount of coupling to be substantially the same for the data lines coupled to the sub-pixels having the same color. For example, the voltage level of the blue data signal D_B provided to the third data line DL3 coupled to the blue sub-pixel SPX_B of the Kth unit pixel PX[K] may be changed by the first green data signal D_G1 provided to the second data line DL2 adjacent to the third data line DL3. Further, the second green data signal D_G2 provided to the fourth data line DL4 adjacent to the third data line DL3 may change the voltage level of the blue data signal D_B provided to the third data line DL3. The voltage level of the blue data signal D_B provided to the seventh data line DL7 coupled to the blue sub-pixel SPX_B of the (K+1)th unit pixel PX[K+1] may be changed by the first green data signal D_G1 provided to the sixth data line DL6 adjacent to the seventh data line DL7. Further, the second green data signal D_G2 provided to the eighth data line DL8 adjacent to the seventh data line DL7 may change the voltage level of the blue data signal D_B provided to the seventh data line DL7. Further, the voltage level of the blue data signal D_B provided to the eleventh data line DL11 coupled to the blue sub-pixel SPX_B of the (K+2)th unit pixel PX[K+2] may be changed by the first green data signal D_G1 provided to the tenth data line DL10 adjacent to the eleventh data line DL11. Further, the second green data signal D_G2 provided to the twelfth data line DL12 adjacent to the eleventh data line DL11 may change the voltage level of the blue data signal D_B provided to the eleventh data line DL11. For example, for each unit pixel PX[K], PX[K+1], PX[K+2] and PX[K+3], the voltage level of the blue data signal D_B provided to the blue sub-pixel SPX_B included in each of the unit pixels PX[K], PX[K+1], PX[K+2] and PX[K+3] may be changed by the coupling effect generated by the first green data signal D_G1 provided to the first green sub-pixel SPX_G1 adjacent to the blue sub-pixel SPX_B and the second green sub-pixel SPX_G2 adjacent to the blue sub-pixel SPX_B. Thus, the voltage level of the blue data signal D_B provided to the blue sub-pixel SPX_B included in each of the unit pixels PX[K], PX[K+1], PX[K+2] and PX[K+3] may be the same. Therefore, a color variation of the blue sub-pixels SPX_B included in the unit pixels PX[K], PX[K+1], PX[K+2] and PX[K+3] may be improved.

Figure 7:
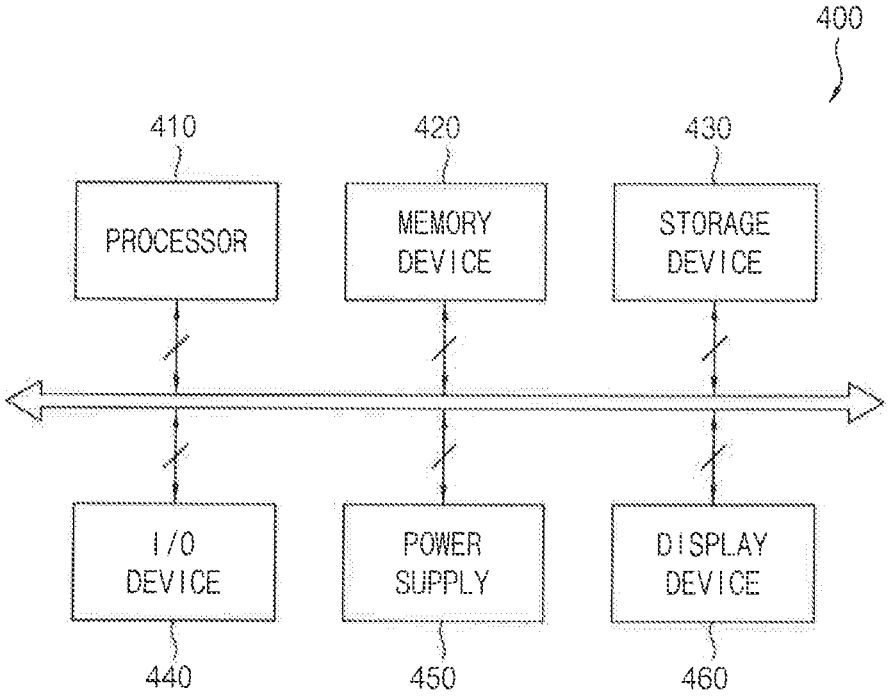
FIG. 7 is a block diagram illustrating an electronic device according to an exemplary embodiment of the present inventive concept.
Figure 8:
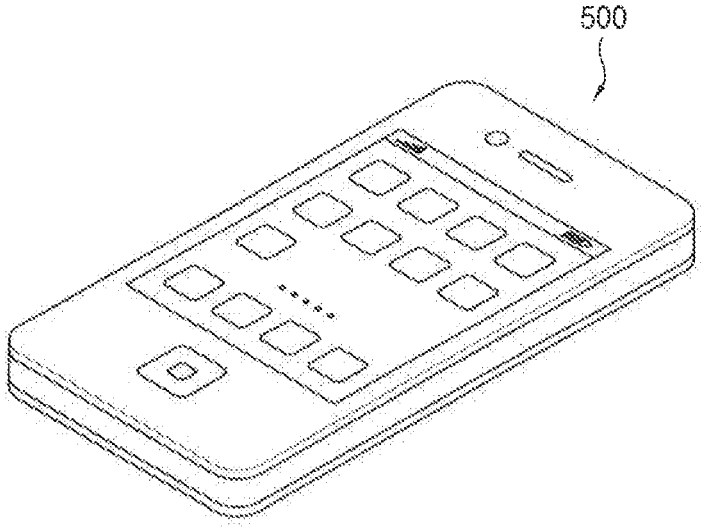
FIG. 8 is a diagram illustrating an exemplary embodiment of the present inventive concept in which the electronic device of FIG. 7 is implemented as a smart phone.

FIG. 7 is a block diagram illustrating an electronic device 400 according to an exemplary embodiment of the present inventive concept and FIG. 8 is a diagram illustrating an exemplary embodiment of the present inventive concept in which the electronic device 400 of FIG. 7 is implemented as a smart phone.

Referring to FIGS. 7 and 8 an electronic device 400 may include a processor 410, a memory device 420, a storage device 430, an input/output (I/O) device 440, a power supply 450, and a display device 460. Here, the display device 460 may be the display device 100 of FIG. 1. In addition, the electronic device 400 may further include a plurality of ports for communicating with a video card, a sound card, a memory card, a universal serial bus (USB) device, other electronic devices, etc. In FIG. 8 the electronic device 400 is implemented as a smart phone 500. However, exemplary embodiments of the present inventive concept are not limited thereto.

The processor 410 may perform various computing functions. The processor 410 may be a microprocessor, a central processing unit (CPU), etc. The processor 410 may be coupled to other components via an address bus, a control bus, a data bus, etc. Further, the processor 410 may be coupled to an extended bus such as a surrounded component interconnect (PCI) bus. The memory device 420 may store data for operations of the electronic device 400. For example, the memory device 420 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc. The storage device 430 may be a solid state drive (SSD) device, a hard disk drive (HDD) device, a CD-ROM device, etc.

The I/O device 440 may be an input device such as a keyboard, a keypad, a touchpad, a touch-screen, a mouse, etc, and an output device such as a printer, a speaker, etc. In an exemplary embodiment of the present inventive concept, the display device 460 may be included in the I/O device 440. The power supply 450 may provide power for operations of the electronic device 400. The display device 460 may communicate with other components via the buses or other communication links. As described above, the display device 460 may include a display panel 110, a scan driver 120, a data driver 130, a plurality of demultiplexers 140, and a timing controller 150.

A plurality of scan lines SL and a plurality of data lines DL may be positioned on the display panel 110. A plurality of pixels PX[K], PX[K+1], PX[K+2] and PX[K+3] may be positioned at regions where the scan lines SL and the data lines DL intersect. Each of unit pixels PX[K], PX[K+1], PX[K+2] and PX[K+3] may include a red sub-pixel, a first green sub-pixel, a blue sub-pixel, and a second green sub-pixel.

The scan driver 120 may generate a scan signal SCAN based on a scan control signal CLS provided form the timing controller 150. The scan driver 120 may provide scan signal SCAN to the unit pixels PX[K], PX[K+1], PX[K+2] and PX[K+3]. The data driver 130 may generate a data signal DATA based on an input signal R, G1, B, G2 and a data control signal CLD provided form the timing controller 150. The data driver 130 may provide the data signal DATA to the demultiplexers 140 through output channels OC using a time division method.

The demultiplexers 140 may control an amount of coupling of the data lines DL by controlling the data signal DATA, which may be provided to the unit pixel PX[K], PX[K+1], PX[K+2] and PX[K+3], in response to a plurality of select signals CL sequentially provided from the timing controller 150. An Nth demultiplexer may include a first through sixth select switching transistors TS1 through TS6. The first through sixth select switching transistors TS1 through TS6 may be coupled to an Nth output channel OC[N] of the data driver 200. The first select switching transistor TS1 may couple the Nth output channel OC[N] to a first data line DL1 coupled to the red sub-pixel SPX_R of a Kth unit pixel PX[K]. The second select switching transistor TS2 may couple the Nth output channel OC[N] to a second data line DL2 coupled to the first green sub-pixel SPX_G1 of the Kth unit pixel PX[K]. The third select switching transistor TS3 may couple the Nth output channel OC[N] to a fifth data line DL5 coupled to the red sub-pixel SPX_R of the (K+1)th unit pixel PX[K+1]. The fourth select switching transistor TS4 may couple the Nth output channel OC[N] to a sixth data line DL6 coupled to the first green sub-pixel SPX_G1 of the (K+1)th unit pixel PX[K+1]. The fifth select switching transistor TS5 may couple the Nth output channel OC[N] to a third data line DL3 coupled to the blue sub-pixel SPX_B of the Kth unit pixel PX[K]. The sixth select switching transistor TS6 may couple the Nth output channel OC[N] to a fourth data line DL4 coupled to the second green sub-pixel SPX_G2 of the Kth unit pixel PX[K]. As described above, the Nth demultiplexer 210 may provide data signals DATA to the Kth unit pixel PX[K] and the (K+1)th unit pixel PX[K+1] through the first through sixth data lines DL1 through DL6. The (N+1)th demultiplexer 220 may include a seventh through twelfth select switching transistors TS7 through TS12. The seventh through twelfth select switching transistors TS7 through TS12 may be coupled to an (N+1)th output channel OC[N+1] of the data driver of FIG. 1. The seventh select switching transistor TS7 may couple the (N+1)th output channel OC[N] to a ninth data line DL9 coupled to the red sub-pixel SPX-R of a (K+2)th unit pixel PX[K+2]. The eighth select switching transistor may couple the (N+1)th output channel to a tenth data line coupled to the first green sub-pixel of the (K+2)th unit pixel. The ninth select switching transistor TS9 may couple the (N+1)th output channel OC[N] to an eleventh data line DL11 coupled to a blue sub-pixel SPX_B of the (K+2)th unit pixel PX[K+2]. The tenth select switching transistor TS10 may couple the (N+1)th output channel OC[N+1] to a twelfth data line DL6 coupled to the second green sub-pixel SPX_G2 of the (K+2)th unit pixel PX[K+2]. The eleventh select switching transistor TS11 may couple the (N+1)th output channel OC[N+1] to a seventh data line DL7 coupled to the blue sub-pixel SPX_B of the (K+1)th unit pixel PX[K+1]. The twelfth select switching transistor TS12 may couple the (N+1)th output channel OC[N+1] to an eighth data line DL8 coupled to the second green sub-pixel SPX_G2 of the (K+1)th unit pixel PX[K+1]. As described above, the (N+1)th demultiplexer 220 may provide data signals DATA to the (K+1)th unit pixel PX[K+1] and the (K+2)th unit pixel PX[K+2] through the seventh through twelfth data lines DL7 through DL12. The first through twelfth select switching transistors TS1 through TS12 may sequentially turn on in response to the first through sixth select signals CL1 through CL6 provided form the timing controller 150. The demultiplexer (e.g., 140 of FIG. 1) included in the display device 460 may allow particular amounts of coupling, which affect the data lines DL coupled to the sub-pixels having the same color, to be the substantially the same for subs-pixels having the same color by changing a coupling structure of the first through twelfth switching transistors TS1 through TS12 and the data lines DL. Thus, the voltage level of the data signal DATA provided to the sub-pixels having the same color may be the same. For example, the demultiplexer (e.g., 210, 220 and 230 of FIG. 3) may allow the particular amount of coupling that affects the data lines DL coupled to the red sub-pixels SPX_R to be substantially the same. The demultiplexer (e.g., 210, 220 and 230 of FIG. 3) may allow the particular amount of coupling that affects the data lines DL coupled to the first green sub-pixels SPX_G1 to be substantially the same. The demultiplexer (e.g., 210, 220 and 230 of FIG. 3) may allow the particular amount of coupling that affects the data lines DL coupled to the blue sub-pixels SPX_B to be substantially the same. The demultiplexer (e.g., 210, 220 and 230 of FIG. 3) may allow the particular amount of coupling that affects the data lines DL coupled to the second green sub-pixels SPX_G2 to be substantially the same.

The timing controller 150 may control the scan driver 120, the data driver 130, and the demultiplexers (e.g., 210, 220 and 230 of FIG. 3). The timing controller 150 may provide the scan control signal CLS to the scan driver 120. The timing controller 150 may provide the input signal R, G1, B, G2 and the data control signal CLD to the data driver 130. Further, the timing controller 150 may provide the select signals CL, which control an operation of the demultiplexers (e.g., 210, 220 and 230 of FIG. 3), to the demultiplexers (e.g., 210, 220 and 230 of FIG. 3).

As described above, the display device 460 included in the electronic device 400 of FIG. 7 may control the data signal DATA provided to the unit pixels PX[K], PX[K+1] and PX[K+2] of the display panel 110 by including the demultiplexer 140 between the data driver 130 and the display panel 110. The demultiplexers 140 may allow the particular amount of the coupling, which affects the data lines DL coupled to the sub-pixels having the same color, to be substantially the same for sub-pixels having the same color. Thus, the voltage level of the data signal DATA provided to the sub-pixels having the same color may be the same. Therefore, a color deviation resulting from the coupling effect may be improved.

The present inventive concept may be applied to a display device and an electronic device having the display device. For example, the present inventive concept may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

While the present inventive concept has been particularly shown and described with reference to exemplary embodiments thereof, it will be apparent to those of ordinary skill in the art that various changes in form and detail may be made thereto without departing from the spirit and scope of the present inventive concept as defined by the following claims.

What is claimed is:

1. A display device comprising:

a display panel including a plurality of scan lines, a plurality of data lines, and a plurality of unit pixels, wherein each unit pixel includes a plurality of sub-pixels, each coupled to a respective data line, the plurality of sub-pixels includes a red sub-pixel, a first green sub-pixel, a blue sub-pixel, and a second green sub-pixel;

a data driver configured to output data signals via output channels;

a plurality of demultiplexers configured to selectively connect data signals output from the output channels to the plurality of sub-pixels in response to a plurality of select signals that are sequentially provided to the plurality of demultiplexers, wherein an Nth demultiplexer of the plurality of demultiplexers is coupled to the red sub-pixel of a Kth unit pixel, the first green sub-pixel of the Kth unit pixel, the blue sub-pixel of the Kth unit pixel, the second green sub-pixel of the Kth unit pixel, the red sub-pixel of a (K+1)th unit pixel, and the first green sub-pixel of the (K+1)th unit pixel;

a scan driver configured to provide scan signals to the unit pixels through the scan lines; and a timing controller configured to control the demultiplexers, the data driver, and the scan driver.

2. The display device of claim 1, wherein an Nth demultiplexer is coupled to an Nth output channel, wherein N is an integer equal to or greater than 1.

3. The display device of claim 2, wherein an (N+1)th demultiplexer is coupled to the blue sub-pixel of the (K+1)th unit pixel, the second green sub-pixel of the (K+1)th unit pixel, the red sub-pixel of a (K+2)th unit pixel, the first green sub-pixel of the (K+2)th unit pixel, the blue sub-pixel of the (K+2)th unit pixel, and the second green sub-pixel of the (K+2)th unit pixel, wherein K is an integer equal to or greater than 1.

4. The display device of claim 3, wherein the Nth demultiplexer includes:

a first select switching transistor configured to couple the Nth output channel and the data line, which is coupled to the red sub-pixel of the Kth unit pixel, in response to a first select signal;

a second select switching transistor configured to couple the Nth output channel and the data line, which is coupled to the first green sub-pixel of the Kth unit pixel, in response to a second select signal;

a third select switching transistor configured to couple the Nth output channel and the data line, which is coupled to the red sub-pixel of the (K+1)th unit pixel, in response to a third select signal;

a fourth select switching transistor configured to couple the Nth output channel and the data line, which is coupled to the first green sub-pixel of the (K+1)th unit pixel, in response to a fourth select signal;

a fifth select switching transistor configured to couple the Nth output channel and the data line, which is coupled to the blue sub-pixel of the Kth unit pixel, in response to a fifth select signal; and a sixth select switching transistor configured to couple the Nth output channel and the data line, which is coupled to the second green sub-pixel of the Kth unit pixel, in response to a sixth select signal.

5. The display device of claim 4, wherein the (N+1)th demultiplexer includes:

a seventh select switching transistor configured to couple the (N+1)th output channel and the data line, which is coupled to the red sub-pixel of the (K+2)th unit pixel, in response to the first select signal;

an eighth select switching transistor configured to couple the (N+1)th output channel and the data line, which is coupled to the first green sub-pixel of the (K+2)th unit pixel, in response to the second select signal;

a ninth select switching transistor configured to couple the (N+11)th output channel and the data line, which is coupled to the blue sub-pixel of the (K+2)th unit pixel, in response to the third select signal;

a tenth select switching transistor configured to couple the (N+1)th output channel and the data line, which is coupled to the second green sub-pixel of the (K+2)th unit pixel, in response to the fourth select signal;

an eleventh select switching transistor configured to couple the (N+1)th output channel and the data line, which is coupled to the blue sub-pixel of the (K+1)th unit pixel, in response to the fifth select signal; and a twelfth select switching transistor configured to couple the (N+1)th output channel and the data line, which is coupled to the second green sub-pixel of the (K+1)th unit pixel, in response to the sixth select signal.

6. The display device of claim 3, wherein the Nth demultiplexer includes:

a first select switching transistor configured to couple the Nth output channel and the data line, which is coupled to the red sub-pixel of the Kth unit pixel, in response to a first select signal;

a second select switching transistor configured to couple the Nth output channel and the data line, which is coupled to the blue sub-pixel of the Kth unit pixel, in response to a second select signal;

a third select switching transistor configured to couple the Nth output channel and the data line, which is coupled to the red sub-pixel of the (K+1)th unit pixel, in response to a third select signal;

a fourth select switching transistor configured to couple the Nth output channel and the data line, which is coupled to the first green sub-pixel of the Kth unit pixel, in response to a fourth select signal;

a fifth select switching transistor configured to couple the Nth output channel and the data line, which is coupled to the second green sub-pixel of the Kth unit pixel, in response to a fifth select signal; and a sixth select switching transistor configured to couple the Nth output channel and the data line, which is coupled to the first green sub-pixel of the (K+1)th unit pixel, in response to a sixth select signal.

7. The display device of claim 6, wherein the (N+1)th demultiplexer includes:

a seventh select switching transistor configured to couple the (N+1)th output channel and the data line, which is coupled to the blue sub-pixel of the (K+1)th unit pixel, in response to the first select signal;

an eighth select switching transistor configured to couple the (N+1)th output channel and the data line, which is coupled to the red sub-pixel of the (K+2)th unit pixel, in response to the second select signal;

a ninth select switching transistor configured to couple the (N+1)th output channel and the data line, which is coupled to the blue sub-pixel of the (K+2)th unit pixel, in response to the third select signal;

a tenth select switching transistor configured to couple th (N+1)th output channel and the data line, which is coupled to the second green sub-pixel of the (K+1)th unit pixel, in response to the fourth select signal;

an eleventh select switching transistor configured to couple th (N+1)th output channel and the data line, which is coupled to the first green sub-pixel of the (K+2)th unit pixel, in response to the fifth select signal; and a twelfth select switching transistor configured to couple th (N+1)th output channel and the data line, which is coupled to the second green sub-pixel of the (K+2)th unit pixel, in response to the sixth select signal.

8. A display device comprising:

a display panel including a plurality of scan lines, a plurality of data lines, and a plurality of unit pixels, wherein each unit pixel includes a plurality of sub-pixels, each coupled to a respective data line, the plurality of sub-pixels includes a red sub-pixel, a first green sub-pixel, a blue sub-pixel, and a second green sub-pixel;

a data driver configured to output data signals via output channels;

a plurality of demultiplexers configured to selectively connect data signals output from the output channels to the plurality of sub-pixels in response to a plurality of select signals that are sequentially provided to the plurality of demultiplexers;

a scan driver configured to provide scan signals to the unit pixels through the scan lines; and a timing controller configured to control the demultiplexers, the data driver, and the scan driver, wherein the demultiplexers allows an amount of coupling that affects the data lines coupled to the red sub-pixels to be substantially the same, an amount of coupling that affects the data lines coupled to the first green sub-pixels to be substantially the same, an amount of coupling that affects the data lines coupled to the blue sub-pixels to be substantially the same, and an amount of coupling that affects the data lines coupled to the second green sub-pixels to be substantially the same.

9. The display device of claim 1, wherein the timing controller generates first through sixth select signals, and sequentially provides the first through sixth select signals to the demultiplexers.

10. The display device of claim 9, wherein the timing controller provides the first through sixth select signals to the demultiplexers during a data input period of the unit pixels.

11. An electronic device includes a display device and a processor that controls the display device, wherein the display device comprises:

a display panel including a plurality of scan lines, a plurality of data lines, and a plurality of unit pixels, wherein each unit pixel includes, in sequence, a red sub-pixel, a first green sub-pixel, a blue sub-pixel, and a second green sub-pixel, each sub-pixel being coupled to a respective data line;

a data driver configured to output data signals via output channels;

a plurality of demultiplexers configured to selectively connect data signals output from the output channels to the plurality of sub-pixels, wherein a first demultiplexer is connected to a first unit pixel of the plurality of unit pixels and a first half portion of a second unit pixel of the plurality of unit pixels, and a second demultiplexer is connected to a second half portion of the second unit pixel and a third unit pixel of the plurality of unit pixels;

a scan driver configured to provide a scan signal to the unit pixels through the scan lines; and a timing controller configured to control the demultiplexers, the data driver, and the scan driver.

12. The electronic device of claim 11, wherein an Nth demultiplexer is coupled to an Nth output channel, wherein N is an integer equal to or greater than 1.

13. The electronic device of claim 12, wherein an Nth demultiplexer is coupled to the red sub-pixel of a Kth unit pixel, the first green sub-pixel of the Kth unit pixel, the blue sub-pixel of the Kth unit pixel, the second green sub-pixel of the Kth unit pixel, the red sub-pixel of a (K+1)th unit pixel, and the first green sub-pixel of the (K+1)th unit pixel, wherein K is an integer equal to or greater than 1, and wherein an (N+1)th demultiplexer is coupled to the blue sub-pixel of the (K+1)th unit pixel, the second green sub-pixel of the (K+1)th unit pixel, the red sub-pixel of a (K+2)th unit pixel, the first green sub-pixel of the (K+2)th unit pixel, the blue sub-pixel of the (K+2)th unit pixel, and the second green sub-pixel of the (K+2)th unit pixel.

14. The electronic device of claim 13, wherein the Nth demultiplexer includes:

a first select switching transistor configured to couple the Nth output channel and the data line, which is coupled to the red sub-pixel of the Kth unit pixel, in response to a first select signal;

a second select switching transistor configured to couple the Nth output channel and the data line, which is coupled to the first green sub-pixel of the Kth unit pixel, in response to a second select signal;

a third select switching transistor configured to couple the Nth output channel and the data line, which is coupled to the red sub-pixel of the (K+1)th unit pixel, in response to a third select signal;

a fourth select switching transistor configured to couple the Nth output channel and the data line, which is coupled to the first green sub-pixel of the (K+1)th unit pixel, in response to a fourth select signal;

a fifth select switching transistor configured to couple the Nth output channel and the data line, which is coupled to the blue sub-pixel of the Kth unit pixel, in response to a fifth select signal; and a sixth select switching transistor configured to couple the Nth output channel and the data line, which is coupled to the second green sub-pixel of the Kth unit pixel, in response to a sixth select signal.

15. The electronic device of claim 14, wherein the (N+1) th demultiplexer includes:

a seventh select switching transistor configured to couple an (N+1)th output channel and the data line, which is coupled to the red sub-pixel of the (K+2)th unit pixel, in response to the first select signal;

an eighth select switching transistor configured to couple the (N+1)th output channel and the data line, which is coupled to the first green sub-pixel of the (K+2)th unit pixel, in response to the second select signal;

a ninth select switching transistor configured to couple the (N+1)th output channel and the data line, which is coupled to the blue sub-pixel of the (K+2)th unit pixel, in response to the third select signal;

a tenth select switching transistor configured to couple the (N+1)th output channel and the data line, which is coupled to the second green sub-pixel of the (K+2)th unit pixel, in response to the fourth select signal;

an eleventh select switching transistor configured to couple the (N+1)th output channel and the data line, which is coupled to the blue sub-pixel of the (K+1)th unit pixel, in response to the fifth select signal; and a twelfth select switching transistor configured to couple the (N+1)th output channel and the data line, which is coupled to the second green sub-pixel of the (K+1)th unit pixel, in response to the sixth select signal.

16. The electronic device of claim 13, wherein the Nth demultiplexer includes:

a first select switching transistor configured to couple the Nth output channel and the data line, which is coupled to the red sub-pixel of the Kth unit pixel, in response to a first select signal;

a second select switching transistor configured to couple the Nth output channel and the data line, which is coupled to the blue sub-pixel of the Kth unit pixel, in response to a second select signal;

a third select switching transistor configured to couple the Nth output channel and the data line, which is coupled to the red sub-pixel of the (K+1)th unit pixel, in response to a third select signal;

a fourth select switching transistor configured to couple the Nth output channel and the data line, which is coupled to the first green sub-pixel of the Kth unit pixel, in response to a fourth select signal;

a fifth select switching transistor configured to couple the Nth output channel and the data line, which is coupled to the second green sub-pixel of the Kth unit pixel, in response to a fifth select signal; and a sixth select switching transistor configured to couple the Nth output channel and the data line, which is coupled to the first green sub-pixel of the (K+1)th unit pixel, in response to a sixth select signal.

17. The electronic device of claim 16, wherein the (N+1)th demultiplexer includes:

a seventh select switching transistor configured to couple the (N+1)th output channel and the data line, which is coupled to the blue sub-pixel of the (K+1)th unit pixel, in response to the first select signal;

an eighth select switching transistor configured to couple the (N+1)th output channel and the data line, which is coupled to the red sub-pixel of the (K+2)th unit pixel, in response to the second select signal;

a ninth select switching transistor configured to couple the (N+1)th output channel and the data line, which is coupled to the blue sub-pixel of the (K+2)th unit pixel, in response to the third select signal;

a tenth select switching transistor configured to couple the (N+1)th output channel and the data line, which is coupled to the second green sub-pixel of the (K+1)th unit pixel, in response to the fourth select signal;

an eleventh select switching transistor configured to couple the (N+1)th output channel and the data line, which is coupled to the first green sub-pixel of the (K+2)th unit pixel, in response to the fifth select signal; and a twelfth select switching transistor configured to couple the (N+1)th output channel and the data line, which is coupled to the second green sub-pixel of the (K+2)th unit pixel, in response to the sixth select signal.

18. The electronic device of claim 11, wherein the demultiplexers allows an amount of coupling that affects the data lines coupled to the red sub-pixels to be substantially the same, an amount of coupling that affects the data lines coupled to the first green sub-pixels to be substantially the same, an amount of coupling that affects the data lines coupled to the blue sub-pixels to be substantially the same, and an amount of coupling that affects the data lines coupled to the second green sub-pixels to be substantially the same.

19. The electronic device of claim 11, wherein the timing controller generates first through sixth select signals, and sequentially provides the first through sixth select signals to the demultiplexers.

20. The electronic device of claim 19, wherein the timing controller provides the first through sixth select signals to the demultiplexers during a data input period of the unit pixels.

* * * * *